US006640808B1

(12) United States Patent
Fessler

(10) Patent No.: US 6,640,808 B1
(45) Date of Patent: Nov. 4, 2003

(54) APPARATUS FOR SEXUAL INTERCOURSE

(76) Inventor: Jeffrey E. Fessler, P.O. Box 295, Godfrey, IL (US) 62035

( * ) Notice: Subject to any disclaimer, the term of this patent is extended or adjusted under 35 U.S.C. 154(b) by 0 days.

(21) Appl. No.: 10/263,208

(22) Filed: Oct. 2, 2002

(51) Int. Cl.[7] ..... A61G 15/00
(52) U.S. Cl. ..... 128/845; 600/38
(58) Field of Search ..... 128/845, 846, 128/869, 870; 600/38; 297/245, 246

(56) References Cited

U.S. PATENT DOCUMENTS

| | | | |
|---|---|---|---|
| 3,711,152 | A | 1/1973 | Sirpak et al. |
| 3,813,091 | A | 5/1974 | Metzger |
| 3,845,945 | A | 11/1974 | Lawley et al. |
| 3,890,004 | A | 6/1975 | Rail |
| 3,971,592 | A | 7/1976 | Farley |
| 4,221,370 | A | 9/1980 | Redwine |
| 4,541,622 | A | 9/1985 | Tabuchi |
| 4,571,761 | A | 2/1986 | Perlin |
| 4,940,286 | A | 7/1990 | Nguti |
| 5,294,176 | A | 3/1994 | Asinovsky |
| 5,443,532 | A | 8/1995 | Hudak |
| 5,538,011 | A | 7/1996 | Craft et al. |
| 5,875,779 | A | 3/1999 | Fuhrman et al. |
| 6,030,039 | A | 2/2000 | Essler |
| 6,135,552 | A | 10/2000 | Waguri |

*Primary Examiner*—Michael A. Brown
(74) *Attorney, Agent, or Firm*—Don W. Weber

(57) ABSTRACT

An apparatus for sexual intercourse includes two arcuate-shaped legs connected by a centrally located brace and another brace located near the head portion of the padded support. A padded support for a non-dominant sexual partner is located between the two braces, to support the partner's head and hips. A seat is located for the dominant partner, the seat being located between the arcuate legs near the hip portion of the flat padded support. A handrail is located above the flat padded support such that it is within easy reach of either participant. Supine footrests are located in front of the hip portion of the padded support for use when the non-dominate partner is in a supine position. Upright footrests are also located near the center of the flat padded support for use in other sexual positions. The flat padded support is connected to the main frame by a number of springs such that a rocking or lateral or forward motion can be achieved by the participants with minimal efforts.

3 Claims, 3 Drawing Sheets

APPARATUS FOR SEXUAL INTERCOURSE

BACKGROUND OF THE INVENTION

This invention relates generally to the field of human support apparatus such as beds or chairs. More particularly, a combined position support and chair are presented which facilitate sexual intercourse.

A number of devices have been produced which are designed specifically to facilitate the act of sexual intercourse. Among these are beds, chairs, and other supports which enable the participants to engage in sexual intercourse in various positions while supporting the bodies of the participants. One such device is found in the 1999 U.S. Patent issued to Fuhrman (U.S. Pat. No. 5,875,779). Fuhrman disclosed an arcuately reciprocating human sexual fitness machine. Fuhrman has a seat for the male and a reciprocating and pivoting seat for the female which is placed about a horizontal axis to pivot toward and away from the male seat. The female seat is counterbalanced to provide a levitating effect as the seat pivots forward. Fuhrman discloses a device for facilitating sexual intercourse by moving the female's position forward towards the seated male position.

Other devices in the field have dealt with the general proposition that sexual intercourse may be facilitated by use of a support other than a conventional bed. For example, folding chairs, rim chairs, reclining platforms and other types of devices have been disclosed in the prior art. However, none of the prior art discloses a device for practicing sexual intercourse using varied positions and methods. It is an object of this invention to provide an apparatus for performing sexual intercourse using different methods and positions.

Most of the other art devices disclosed do not provide support for the female and the male both. In some positions, it is important for both the male and female to be supported during sexual intercourse. It is another object of this invention to provide a support for both the male and female during acts of sexual intercourse.

While there are many positions available for practicing sexual intercourse, the apparatus or supports for such activity are quite limited. For example, when utilizing the standard flat bed, certain positions may become uncomfortable or tiring. It would be of benefit to this particular field if a device were disclosed which can be utilized when practicing varying methods for performing the sex act. It is a still further object of this invention to provide an apparatus which may be utilized during sex while employing varying methods and positions.

Other and further objects of this invention will become apparent upon reading the below described Specification.

BRIEF SUMMARY OF THE INVENTION

A sexual intercourse apparatus includes an arcuate tubular frame which supports a flat, horizontal padded surface for one participant to lay in a supine position. Also included is a seat for the other partner as well as upper handlebars and a plurality of footrests. The horizontal, padded, non-dominant platform is mounted on springs. The location and orientation of the handles, footrests, flat horizontal padded platform and seat are compatible with performing acts of sexual intercourse or in participating in varied forms of sexual activity while maintaining support and positioning for the participants.

DETAILED DESCRIPTION OF THE PREFERRED EMBODIMENT

Figure 1:
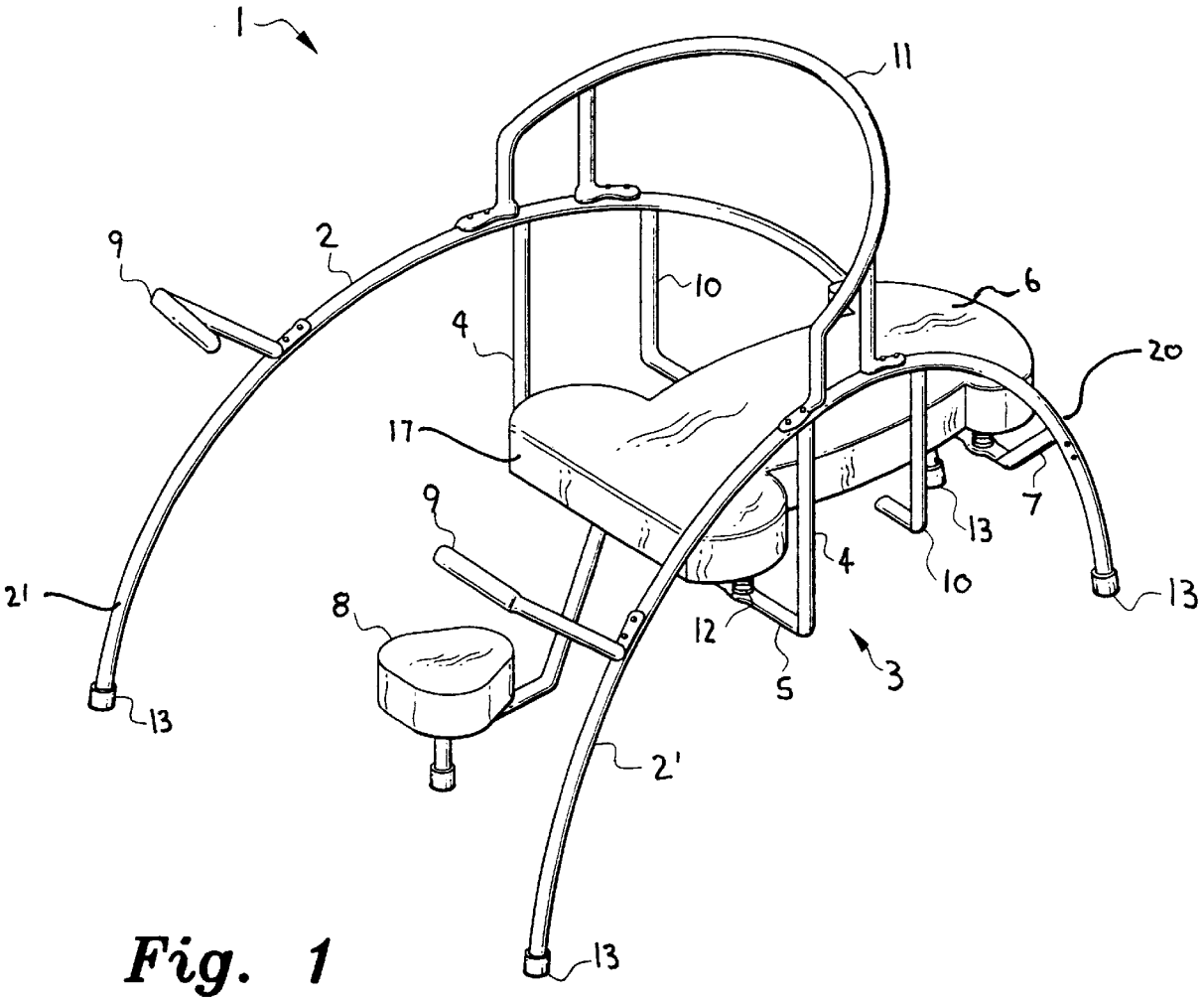
FIG. 1 is a front perspective view of the apparatus.

An apparatus for sexual intercourse is made of essentially tubular material and a padded platform and seat attached to the tubular frame. The apparatus, to be marketed commercially as the "DO-ME Chair"™, is shown generally in FIG. 1.

The apparatus 1 has left 2 and right 2' tubular, arcuate inverted U-shaped supporting legs, which form the frame. The left 2 and right 2' arcuate legs are connected near the apex or center of the arc by a center bracket shown generally at 3. This center bracket 3 is made up of vertical bracket leg sections 4 connected at their ends to a horizontal leg bracket section 5. The upper portions of the vertical leg brackets 4 are connected to the arcuate supporting legs 2 and 2' as shown. The frame has a head end 20 and a seat end 21, as shown on FIG. 1.

A non-dominant, padded, essentially horizontal support 6 is supported by the center bracket apparatus 3. The non-dominant flat support 6 has a hip end 17 and a head end 18, as best shown on FIG. 3. The hip end 17 is adapted to receive the pelvic and hip area of the non-dominant sexual intercourse partner, while the head end 18 is adapted to receive the head of the non-dominant partner. This padded support 6 comprises a firm base, and is made of approximately two inches of foam rubber and a decorative cover.

Figure 3:
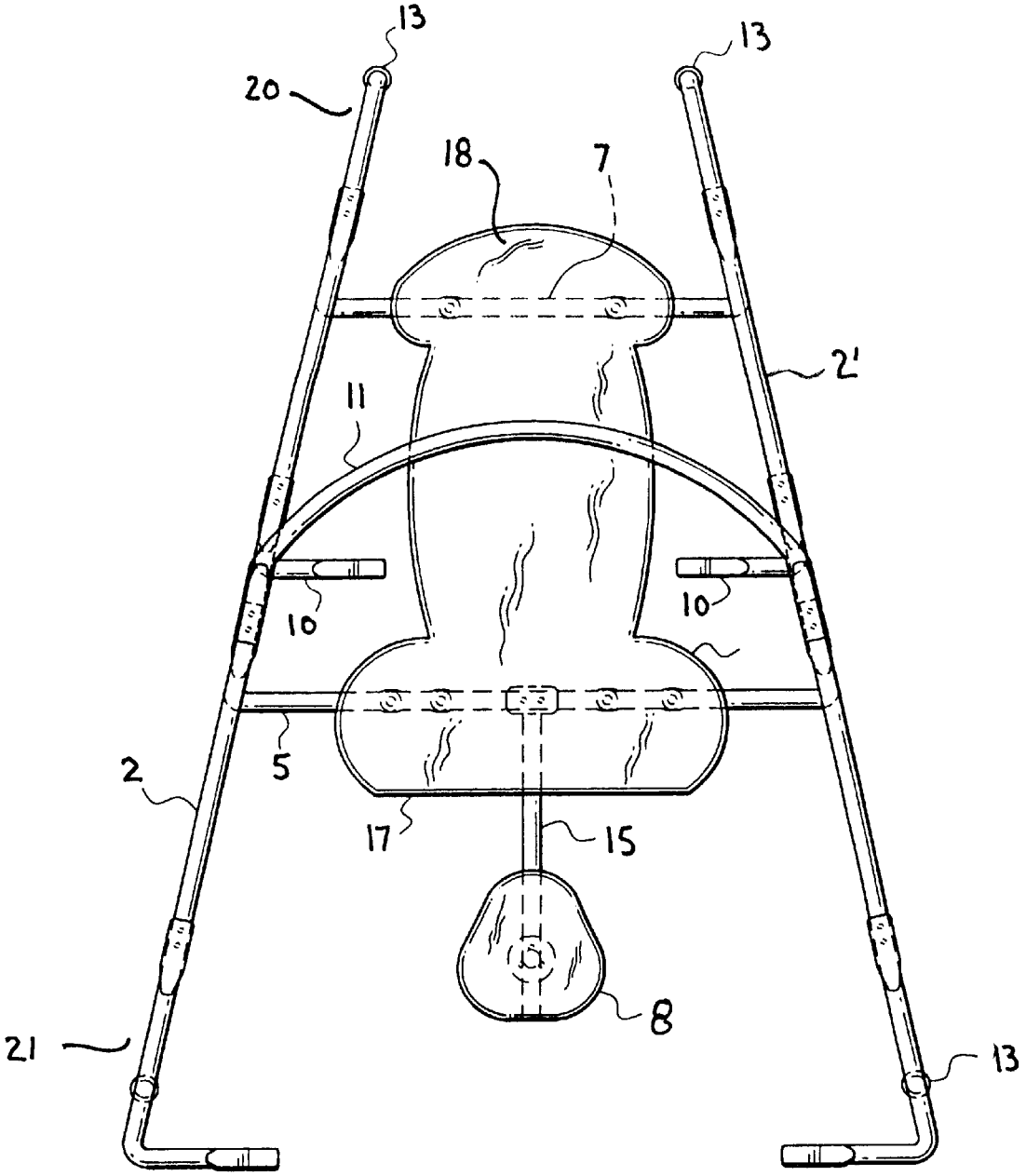
FIG. 3 is a top plan view of the apparatus shown in FIG. 1.

The head end 18 of the non-dominant flat support 6 is also supported by a non-dominant padded support brace 7. The opposite ends of brace 7 are connected to left 2 and right 2' arcuate supporting legs near the head end 20 as best shown in FIGS. 1 and 3 The head part 18 of the non-dominant flat support 6 is connected to and supported by the non-dominant support brace 7.

While the non-dominant flat support 6 is designed to support the non-dominant partner during sexual acts, provision is also made for the dominant sexual partner to be seated on a dominant padded seat 8. This dominant padded seat 8 is shown in Drawing FIGS. 1 through 3. The seat 8 is padded in the preferred embodiment.

In order to facilitate the act of sexual intercourse, and other sex acts, two pairs of footrests are provided on the apparatus. Supine position foot rests 9 are located near the dominant padded seat 8 and are connected to left 2 and right 2' arcuate legs, respectively, near the seat end of the device. Each footrest 9 is located such that the non-dominant sexual intercourse partner can rest her feet and part of her body weight on the footrests.

In certain other methods of sexual conduct, it is desirable to have footrests located near the center of the non-dominant flat support 6. A pair of upright position footrests 10 are connected to the left and right supporting legs, respectively, and are located near the center of the non-dominant flat support 6. Each of these footrests is connected, respectively, to left 2 and right 2' arcuate legs as best shown in FIGS. 1 and 3.

Figure 2:
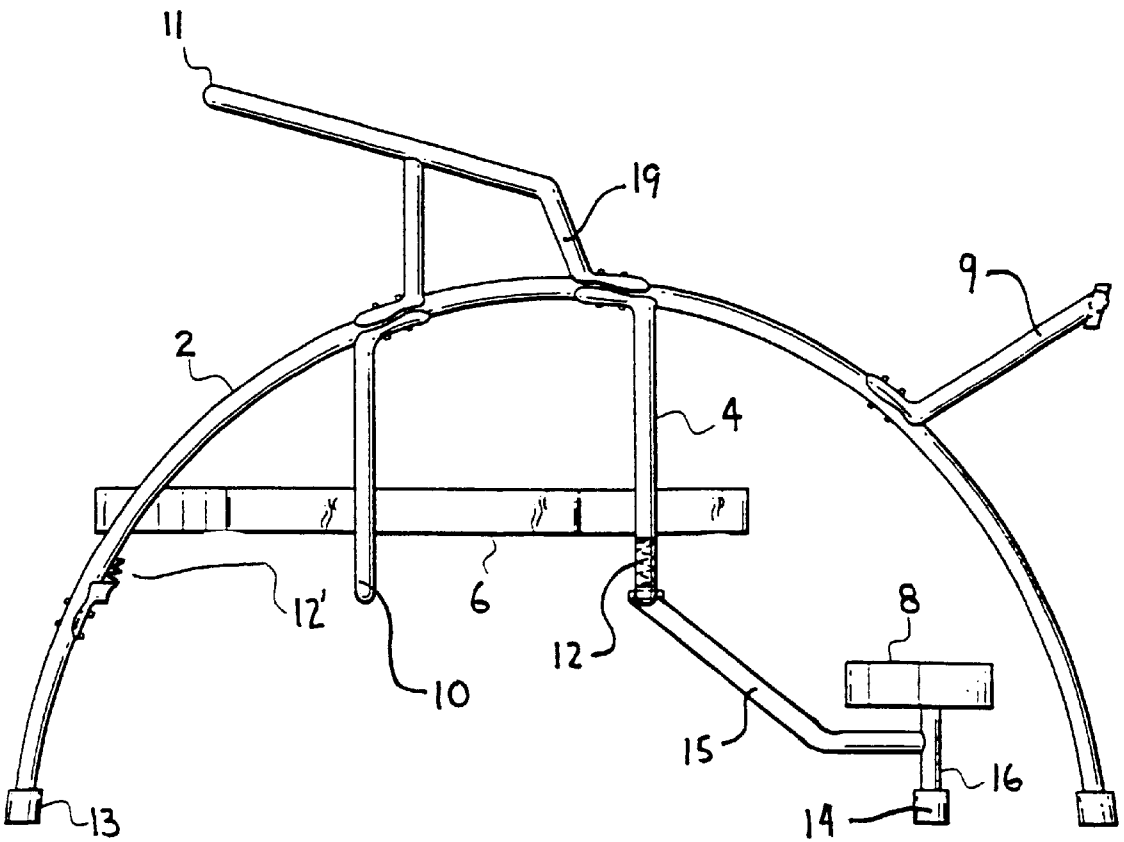
FIG. 2 is a left side view of the apparatus shown in FIG. 1.

In order to facilitate various acts of sexual conduct, an upper handrail support 11 is attached to the top of the arcuate legs 2 and 2' near the center bracket 3. This handrail support 11 is arcuate in shape. The lower ends 19 of the handrail 11 are connected to the arcuate legs 2 and 2' near the center bracket 3. The arcuate handrail 11 is connected at an oblique angle 19 as best shown in FIG. 2. The handrail 11 slopes upwardly from the hip part 17 of the flat support 6 towards the head part 18 of the flat support 6.

In order to enhance the motion of the non-dominant partner on the non-dominant, flat, padded support 6, springs 12 are provided. A plurality of springs connect the head part 18 and the hip part 17 of the flat padded support 6 to the center bracket 3 and non-dominant support brace 7, respectively. Hip portion springs 12 and head portion springs 12' connect the flat padded support 6 to the center bracket 3 and the non-dominant brace 7, respectively, as best shown in FIGS. 1 and 2. In the preferred embodiment, a pair of springs support the head portion and a pair of springs support the hip portion, at the approximate corners of the support 6. These vertically mounted compression springs facilitate both horizontal and vertical movement.

Each end of the left 2 and right 2' arcuate-shaped legs have end caps 13. These end caps provide better stability for the apparatus and also close off the tubular cross section of the arcuate-shaped legs.

Non-dominant flat padded support brace 7, as best shown in FIG. 1, is connected to the left 2 and fight 2' arcuate legs. The non-dominant flat padded support 6 is connected to the non-dominant padded support brace 7 by a plurality of head springs 12' as best shown in FIGS. 1 and 2. Since the non-dominant flat padded support 6 is now connected to the arcuate legs 2 and 2', and hence the apparatus frame only through springs, the flat support 6 can move in a variety of directions. For example, the flat support 6 can rock from head to hip, can move in the direction of the head, or in the direction of the hip, or can move from left to right as one is facing the flat support 6. The padded support 6 may incline upwardly from hip end to head end in one embodiment.

The dominant padded seat 8 is connected to the apparatus frame. The seat 8 is connected to a vertical seat support 16. The vertical seat support 16 is connected to the horizontal leg 5 of the center bracket 3 by an oblique seat support 15. The dominant partner padded seat 8 is thus connected to the apparatus frame in a stationary position, whereas the non-dominant flat padded support 6 is connected to the apparatus frame by a plurality of springs. The vertical seat support 16 has the seat end cap 14 at its lower end.

The apparatus described herein is composed essentially of bent steel tubing, the compression springs, the padded support 6 and the padded seat 8. The tubing is designed for strength, beauty and functionality and should support the weight of two adults, generally in the area of 400–500 pounds. The curved design of the device, as well as the location of the seats and footrests, provides both an esthetically pleasing apparatus as well as a functional device.

The non-dominant flat padded support 6 is adapted to support a non-dominant partner in either a prone, sideline or side position. The footrests are designed to support the feet and legs in varying positions depending on the location of the non-dominant partner's head, torso, and hips.

The springs enhance the movement efforts of the participants and are designed to support a weight of 500 pounds. The dominant partner seat provides a comfortable option for a variety of sexual positions. The handrail support 11 allows each participant to achieve a handgrip to assist in whatever motion is produced by the sexual activity and the springs in the flat padded support.

In the manufacture of this particular device, the left 2 and right 2' arcuate legs are spaced apart a distance of approximately four feet near the hip part of the padded support 6 and approximately two feet near the head part of the padded support. Each arcuate leg rises approximately 3 feet 4 inches from the floor.

The non-dominant padded support 6 slants slightly upwardly from the hip part to the head part, with a slope of approximately 2 inches.

The padded support 6 and padded seat 8 are fabricated from foam rubber material and may be sprayed with a rubberized outer coating for comfort and durability. Supine position footrests 9 function as footrests when the non-dominant partner is laying in a supine position on the flat, padded support 6. The upright position footrests 10 function as footrests when the non-dominant partner assumes a more upright sitting position on the flat padded support 6.

The tubular members are fabricated, in the preferred embodiment, from 1¼ inches, 11 gauge metal tubing. The tubular members may be attached in any efficient and convenient manner, such as welds, bolts, or other attaching means.

Even individuals with limited strength or mobility will benefit from the use of the instant invention. For example, the chair of the instant invention does not require that the non-dominant partner in the supine position bear the full weight of the dominant partner in the seated position. The compression spring-mounted flat padded support 6 insures that movement is achieved with minimal input of energy from either of the participants.

It is to be understood that one of the important features of the invention is to provide both a flat padded support for the non-dominant partner and a padded seat for the dominant partner. Another important feature of the invention includes the compression springs which connect the flat padded support 6 to the center bracket 3 and the non-dominant brace 7. Another important feature of this invention includes the spatial orientation of the flat padded support 6, the padded seat 8, the handrail support 11 and the supine 9 and upright 10 footrests.

Having fully described my invention, I claim:

1. An apparatus for sexual intercourse, comprising:

(a) a frame comprising left and right supporting legs, having a head end and a seat end;

(b) a center bracket connecting said supporting legs;

(c) a support brace connecting said legs near the head end;

(d) a padded support connected to said center bracket and said support brace by a plurality of springs;

(e) a pair of supine position footrests connected to said left and right support legs, respectively, near said seat end; and (f) a seat, connected to said center bracket between said support legs.

2. An apparatus for sexual intercourse as in claim 1, further comprising a pair of upright position footrests connected to said left and right supporting legs, respectively, near the center of said padded support.

3. An apparatus for sexual intercourse as in claim 1, further comprising an upper handrail connected to the top of said arcuate legs near said center bracket.

* * * * *